United States Patent [19]

Yuhara

[11] Patent Number: 4,474,196

[45] Date of Patent: Oct. 2, 1984

[54] VANITY CASE

[75] Inventor: Yukitomo Yuhara, Abiko, Japan

[73] Assignee: Yoshida Industry Co., Ltd., Tokyo, Japan

[21] Appl. No.: 472,120

[22] Filed: Mar. 4, 1983

[51] Int. Cl.[3] ..... A45D 33/00

[52] U.S. Cl. ..... 132/83 R

[58] Field of Search ..... 132/83 R, 79

[56] References Cited

U.S. PATENT DOCUMENTS

| | | | |
|---|---|---|---|
| 1,688,042 | 10/1928 | Gaess | 132/83 R |
| 4,345,607 | 8/1982 | Contreras | 132/83 R |
| 4,399,826 | 8/1983 | Ogasawara | 132/83 R |

FOREIGN PATENT DOCUMENTS

| | | | |
|---|---|---|---|
| 2106977 | 4/1983 | United Kingdom | 132/79 R |

*Primary Examiner*—Gregory E. McNeill

*Attorney, Agent, or Firm*—Wenderoth, Lind & Ponack

[57] ABSTRACT

A vanity case is provided which comprises a case body, a cover member hinged with the case body, and a slide member adapted to effect the latching-unlatching of the cover member. The slide member is slidably disposed in a recess formed at the rear end of the case and has an enlarged portion at its rear end, which portion is, when pushed forwardly against a spring force, made contact with a projection downwardly extending from the rear end of the cover so as to rotate the cover to an open position. A locking means is provided on the slide member to prevent the rotation of the cover when the slider is in the rearmost position.

6 Claims, 4 Drawing Figures

VANITY CASE

BACKGROUND OF THE INVENTION

The present invention relates to improvement of a vanity case, and more particularly to improvement of a latch-unlatch mechanism for a vanity case in which a case body and a cover member are coupled through a connection between the hinge parts provided at the rear end of the cover member and the recess formed at the rear end of the case body.

In known vanity cases of the abovesaid type, the cover member and case body have a hook-shaped protrusion on the respective forward edge or other appropriate positions, which is generally molded in an integral unit with the cover member or the case body. An elastic engagement and a release of engagement between these protrusions perform the latching-unlatching of the cover member with respect to the case body. In this case, however, in order to release the engagement of the protrusions, which is carried out by finger operation of user, it is required to provide a finger-operation recess on the outer surface of either the case body or the cover member. Such a need of provision of the recess anywhere on the outer surface of the vanity case is a great disadvantage for improving the aesthetic effect in the design of the case. In addition, the latching-unlatching system with the abovesaid construction should have a relatively high accuracy in dimension for obtaining a smooth engagement and disengagement between the protrusions. As a consequence, quite a number of vanity cases are rejected as defective owing to improper engagement, and a low yield is one of the greatest troubles in the production.

In the circumstances, improved vanity cases have been proposed which are shown, for example, in U.S. Pat. Nos. 4,276,893 and 4,331,168. Such vanity case is provided with a slide member in the vicinity of the protrusion of either the case body or the cover member and, by pressing the slide member, the cover is so forced as to separate from the case body whereby the engagement between both protrusions can be released. With this construction, some dimensional error can be allowed. However, this improvement is not free from defects, either. One of the defects is that since the slide member is designed to insert into a cavity slederly extending in the longitudinal direction, a shaking is likely to occur during a long use. Another defect is that since the protrusions and slide member are arranged on relatively noticeable places, an improvement in design cannot be expected satisfactorily. Further, it is also considered to be unsatisfactory that the protrusions are still necessary and the latch-unlatch mechanism must rely on elasticity of the protrusions.

Therefore, an object of the present invention is to provide a vanity case which is free from all the above defects and can permit various kinds of improvements in design by moving the cover member latching-unlatching system from the places exposed to eyes.

Another object of the present invention is to provide a vanity case in which elastic protrusions are no longer necessary to be provided for holding a cover member in a closed position relative to a case body, thus permitting dimentional error to some extent.

A further object of the present invention is to provide a vanity case which is reliable and simple in operation, for example, it can be operated by one touch of a slide member.

SUMMARY OF THE INVENTION

A vanity case according to the present invention comprises a case body for containing cosmetic material, a cover member to be hinged with the case body, and a slide member adapted to effect the latching-unlatching operation of the cover member. The case body is formed at the rear end with a recess into which hinge part provided at the rear end of the cover member is fitted for pivotable connection. The cover member is also provided at the rear end with a projection downwardly extending therefrom. The slide member has an enlarged portion at the rear end and is slidably disposed in the recess without contact with the hinge part, being urged rearwardly by a spring member. At least either a front surface of the enlarged portion or a rear surface of the projection is inclined, and the enlarged portion and the projection are arranged in such a manner that when the slide member is pushed forwardly the enlarged portion makes contact with the projection so as to rotate the cover member to an open position. Provided on the slide member is a locking means which prevents the rotational movement of the cover member to maintain the latter in a closed position when said slide member is in the rearmost position.

Preferably, a bottom surface defining the recess, on which the slide member may be mounted, is formed with a guide groove and the slide member has at its lower surface a pawl which is engaged with the groove for guiding the sliding movement of the slide member.

More preferably, the slide member has a substantially C-shaped cross section, while the projection is provided at the front surface with an engagement hole. The enlarged portion is formed at the rear end of a lower side of the C-shaped slide member, and the locking means may comprise an upper side of the slide member which is entered into the hole when the slider is in the rearmost position.

Further objects and features of the present invention will become apparent from the detailed description of a preferred embodiment thereof when taken in conjunction with the accompanying drawings, in which:

DETAILED DESCRIPTION OF THE INVENTION

Figure 1:
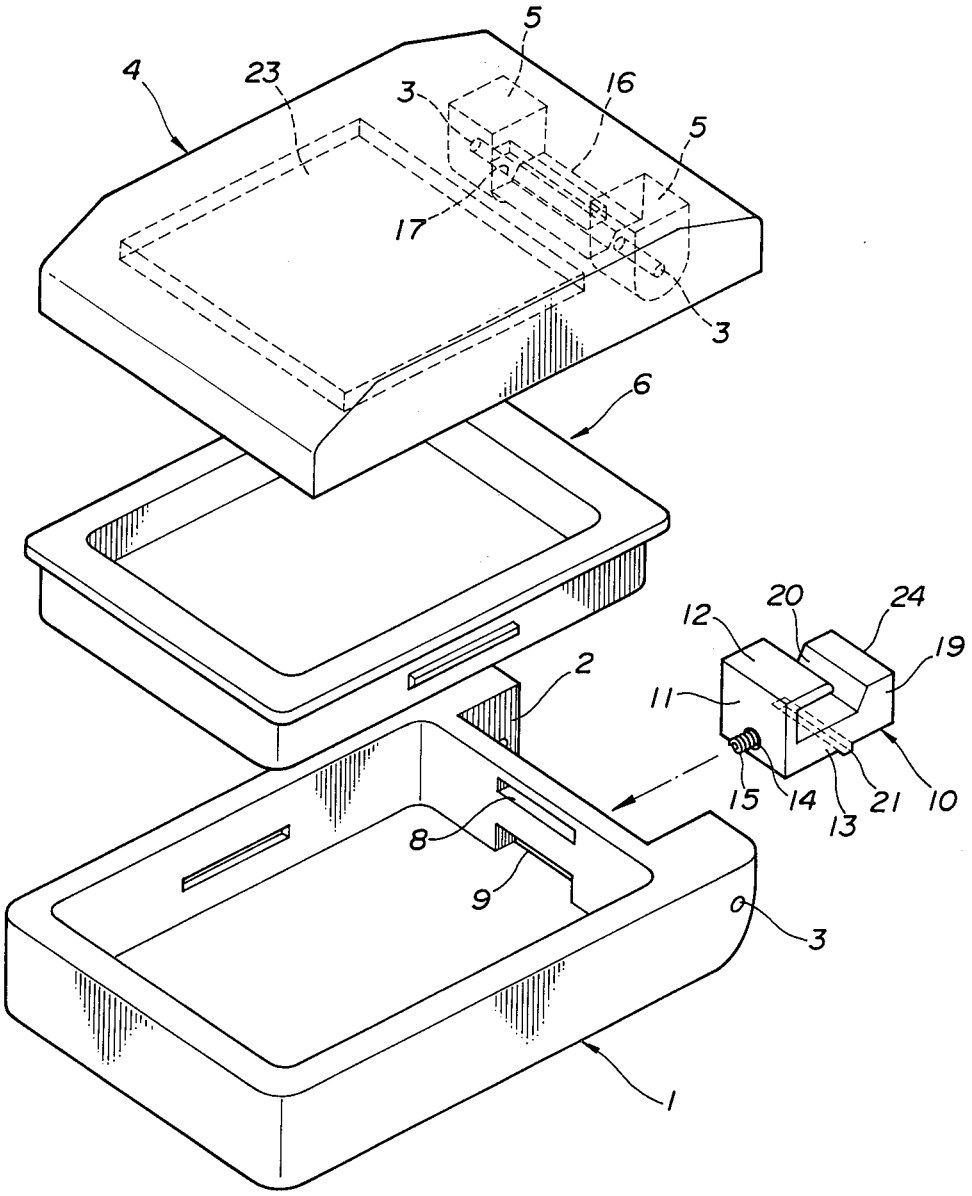
FIG. 1 is an exploded perspective view of a vanity case according to an embodiment of the present invention in which a case body, cover member, cosmetic material containing tray and slide member are not assembled.

Referring now to a preferred embodiment of the present invention shown in FIGS. 1 to 4, in a vanity case, i.e. compact case, of the present invention, a case body 1 has a rectangular recess 2 formed at the rear end, into which a pair of hinge parts 5—5 of a cover member 4 are fitted through a pair of hinge pins 3—3. The case body 1 houses a cosmetic material containing tray 6 fixedly by some suitable fitting means such as a concavo-convex engaging means which may be provided on the both sides of the tray 6 and the case body 1. The cover member 4 is closed or opened with respect to both the case body 1 and cosmetic material containing tray 6 housed therein.

Between the rear wall of the case body 1 and the rear surface of the tray 6, there is formed a gap 7 which communicates with the recess 2 through an upper guide aperture 8 and a lower guide aperture 9 which are provided on the rear wall of the case body 1. In the gap 7, there is arranged a vertical side 11 of a slide member 10 which is substantially shaped in a letter C, with an upper side 12 of the slide member 10 running through the upper guide aperture 8 and a lower side 13 through the lower guide aperture 9.

The slide member 10 has a mounting hole 14 on the front surface of the vertical side 11 and one end of a coil spring 15 is mounted in the mounting hole 14. The other end of the coil spring 15 is connected to the rear wall of the tray 6 so that the spring 15 usually biases the slide member 10 backwardly with respect to the case body 1.

Figure 2:
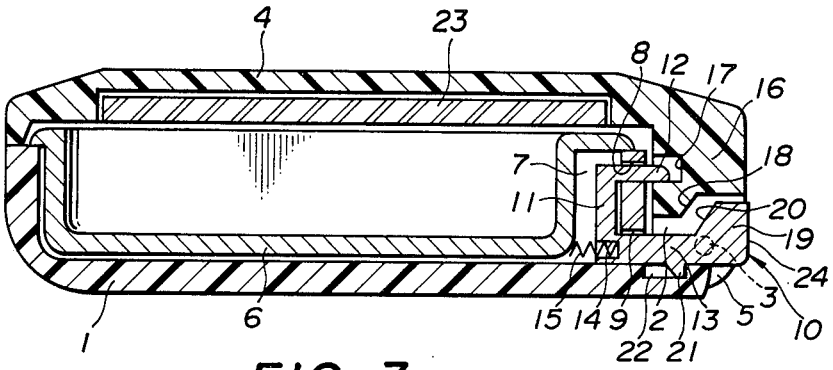
FIG. 2 is a sectional view of the vanity case shown in FIG. 1 in a closed position of the cover member.

The upper side 12 of the slide member 10 running through the upper guide aperture 8 projects into the recess 2 and further enters into an engagement hole 17, which is formed on the front surface of a projection 16 extending downwardly from the rear end of the cover member 4 between the pair of hinge parts 5—5. This state is shown in FIG. 2. The projection 16 is provided with a slant surface 18 on a part of the rear surface.

On the other hand, the lower side 13 of the slide member 10 running through the lower guide aperture 9 also extends into the recess 2. This lower side 13 has an expanded part 19 at the rear end. A front surface 20 of the expanded part 19 is designed to come into contact with the slant surface 18 of the projection 16 when the expanded part 19 is pushed inwardly to slide the slide member 10 forwardly, i.e. from the righthand to the lefthand in the drawings. Therefore, it is preferable to impart the front surface 20 with such a gradient as puts it in parallel with the slant surface 18. A pawl 21 is provided on the lower surface of the slide member 10 in such a manner as it projects downwardly so as to engage with a guide groove 22 which is engraved on the bottom surface defining the recess 2. The utmost slide range of the slide member 10 is determined by the length of the guide groove 22.

On the inner surface of the cover member 4 there is attached fixedly a mirror 23. The tray 6 can contain any kind of cosmetic material as desired. In view that a rear end surface 24 of the expanded part 19 of the slide member 10 is used for pushing the slide member 10 by a user's finger, it is preferably designed to form a substantially vertical wall.

It should be noted here, in comparison with the known vanity cases, that the slide member 10 is housed in the recess 2 formed in the rear part of the vanity case, which is one of the least noticeable places.

According to the vanity case of the present invention with the above described constitution, in the cover member 4 closed position shown in FIG. 2, in which the slide member 10 is at the rearmost position, the tip end of the upper side 12 of the slide member 10 is in an engagement with the engagement hole 17 formed in the projection 16 of the cover member 4, so that the cover member 4 is prevented from rotating. In this state, as the slide member 10 is pressed backwardly by the coil spring 15, the cover member 4 can remain in the closed position even if a shock is applied thereon as when the vanity case slips down from the user's hand. The locking of the cover member 4 is complete.

Figure 3:
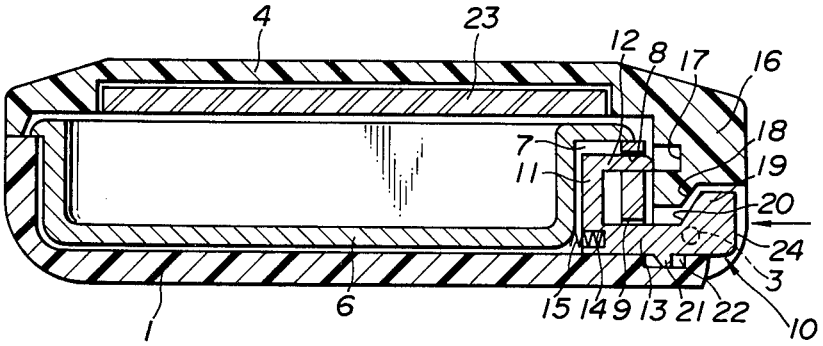
FIG. 3 is a similar sectional view of the vanity case, in which the slide member is pressed to release the latch of the cover member.

Description will proceed to a cover member 4 unlatching operation. At first, as shown in FIG. 3, the rear end surface 24 of the slide member 10 is pushed against the biasing force of the coil spring 15 to slide the slide member 10 forwardly, i.e. to the lefthand in the drawing, so that the tip end of the upper side 12 of the slide member 10 drops out of the engagement with the engagement hole 17 of the projection 16. This means that the locking of the cover member 4 with respect to the case body 1 is released.

Figure 4:
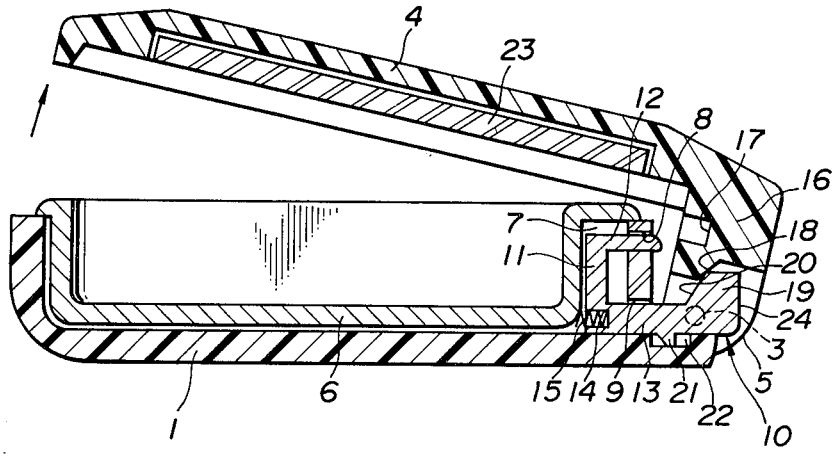
FIG. 4 is a similar sectional view of the vanity case, in which the slide member is pressed further than in FIG. 3 to partially open the cover member.

Then, when the slide member 10 is further pushed as shown in FIG. 4, the front surface 20 of the expanded part 19 comes into a contact with the slant surface 18 of the cover member 4 to give the pressing force to the surface 18, which force is simultaneously converted into a rotational power by the pins 3—3 connecting the cover member 4 to the case body 1. Therefore, the cover member 4 rotates around the hinge pins 3—3 and opens partially at the front end. Thereafter the user can open as widely as he desires to use the cosmetic material and/or mirror 23.

When the pushing force against the slide member 10 is removed, the slide member 10 immediately retreats to its rearmost position limited by the guide groove 22.

In closing the cover member 4, the slide member 10 is made to slide forwardly by the contact between the front surface of the projection 16 and the tip end of the upper side 12 of the slide member 10. Finally, the tip end of the slide member upper side 12 enters automatically into the engagement hole 17, thereby holding the cover member 4 in the closed position.

As it could be understood from the above description, the cover member 4 can be opened quite easily by only pressing the slide member 10 forwardly. Since the tip end of the upper side 12 entered into the hole 17 prevents any rotational movement of the cover member 4, elastic protrusions are no longer requied. The engagement and disengagement of the tip end with the hole 17 is carried out smoothly without snap noise which has been experienced in the known vanity cases.

It may be apparent that the spring member forcing the slide member 10 backwardly may be any suitable one and is not limited to the coil spring 15 as already described and illustrated. Also, the cosmetic material containing tray 6 can be made integrally with the case body 1, and the guide appertures 8 and 9 may be replaced by any other suitable guide means for the slide member 10, such as guide projections provided on the sides of the slide member and slidably engageable with grooves on the sides defining the recess 2.

Furthermore, the projection 16 formed at the rear end of the cover 4 may be so extended that a lower surface thereof is in contact with an upper surface of the expanded part 19 of the slide member 10 when the latter is in the rearmost position. Apparently, such contact can prevent the rotation of the cover member 4 thereby keeping the cover in the closed position. In this case, the vertical side 11 and the upper side 12 of the slide member 10, as well as the engagement hole 17 in the cover member 4, will be eliminated. Instead, the lower surface of the projection 16 may be partially recessed to form a dent. When the slide member is pushed forwardly, it will be located below the dent to release the contact with the lower surface, thereby permitting the rotational movement of the cover 4.

Although the present invention has been described with reference to the preferred embodiment thereof, many modifications and alternations may be made within the spirit of the present invention.

What is claimed is:

1. A vanity case comprising:

a case body for containing cosmetic material therein and having a recess at a rear end thereof;

a cover member having hinge part at a rear end thereof;

said case body and cover member being hinged together by fitting said hinge part into said recess;

said cover member being provided at the rear end with a projection downwardly extending therefrom;

a slide member slidably disposed in said recess of said case body without contact with said hinge part, said slide member having an enlarged portion at a rear end thereof;

at least either a front surface of said enlarged portion or a rear surface of said projection being inclined and said enlarged portion and said projection being arranged in such a manner that when said slide member is pushed forwardly said enlarged portion makes contact with said projection so as to rotate said cover member to an open position;

a spring member urging said slide member rearwardly; and a locking means provided on said slide member for preventing the rotational movement of said cover member to maintain said cover member in a closed position when said slide member is in a rearmost position.

2. A vanity case as claimed in claim 1, wherein said slide member is mounted on a bottom surface defining said recess, said bottom surface being provided with a guide groove, said slide member has a pawl at a lower surface thereof, said pawl being engaged with said groove for guiding the sliding movement of said slide member.

3. A vanity case as claimed in claim 1, wherein said slide member has a substantially C-shaped cross section, said projection is provided at a front surface thereof with an engagement hole, said enlarged portion is formed at the rear end of a lower side of said slide member, and said locking means comprises an upper side of said slide member, said upper side being entered into said hole when said slide member is in the rearmost position.

4. A vanity case as claimed in claim 3, wherein said case body is provided in a rear wall defining said recess with a pair of guide apertures, said lower and upper sides of said slide member pass through said apertures respectively.

5. A vanity case as claimed in claim 4, wherein said case body houses a cosmetic containing tray, a gap is defined between a rear surface of said tray and said rear wall of said case body, and a vertical side of said C-shaped slide member is arranged in said gap.

6. A vanity case as claimed in claim 5, wherein said spring member is connected at one end thereof to said rear surface of said tray and at the other end to said vertical side of said slide member.

* * * * *